United States Patent [19]

Binkowski

[11] 4,282,973

[45] Aug. 11, 1981

[54] PACKAGE FOR FLEXIBLE MAGNETIC MEDIA AND METHOD THEREFOR

[75] Inventor: Constance J. Binkowski, Sunnyvale, Calif.

[73] Assignee: Verbatim Corporation, Sunnyvale, Calif.

[21] Appl. No.: 84,778

[22] Filed: Oct. 15, 1979

[51] Int. Cl.[3] ..... B65D 85/57; B65D 85/62; B65D 71/08; B65D 81/04

[52] U.S. Cl. ..... 206/444; 206/497; 206/523; 53/442

[58] Field of Search ..... 206/309, 303, 445, 444, 206/454, 45.33, 216, 523, 497; 211/40; 53/442

[56] References Cited

U.S. PATENT DOCUMENTS

| | | | |
|---|---|---|---|
| 1,813,178 | 7/1931 | Lindsley | 206/303 |
| 1,891,624 | 12/1932 | Graff | 206/303 |
| 2,842,262 | 7/1958 | Wismer | 206/216 |
| 3,181,766 | 5/1965 | Kane et al. | 206/523 |
| 3,404,771 | 10/1968 | Mann | 206/45.33 |
| 3,549,226 | 12/1970 | Samson | 206/445 |
| 3,618,755 | 11/1971 | Kean, Sr. et al. | 206/454 |
| 3,926,312 | 12/1975 | Elliott et al. | 206/444 |

OTHER PUBLICATIONS

IBM, Technical Disclosure Bulletin, vol. 19, No. 7, Dec. 1976.

*Primary Examiner*—William T. Dixson, Jr.
*Attorney, Agent, or Firm*—Thomas E. Schatzel

[57] ABSTRACT

An improved package for storage and/or shipment of flexible materials which is particularly applicable to packaging a plurality of flexible magnetic disks such as flexible disks. Flexible disks are uniformly aligned and sealed within a heat sealable, heat shrinkable plastic bag. A hole is placed in an edge of the bag for tight draw down, and the bag is heat shrunk. Enhanced protection is afforded by placing and forming a second heat shrunk plastic bag around the first. A foam collar is firmly positioned about the peripheral edge of the package to provide edge protection to the package during shipment. The improved package prevents physical damage to the individual flexible disks from handling, shipping impact and particulate contamination.

19 Claims, 15 Drawing Figures

STEP 1

STEP 2

STEP 3

STEP 4

STEP 5

STEP 1

STEP 2

STEP 3

STEP 4

STEP 5

STEP 1

STEP 2

STEP 3

STEP 4

PACKAGE FOR FLEXIBLE MAGNETIC MEDIA AND METHOD THEREFOR

BACKGROUND OF THE INVENTION

1. Field of the Invention

The present invention relates to packaging thin flexible materials and more particularly to packaging flexible sheet materials in stacks to prevent movement of the individual sheets relative to one another and render said sheets safe from vibrational and impact damage and contamination in transit and/or storage.

2. Description of the Prior Art

Flexible magnetic disks are widely used in the computer industry for recording magnetic data. Such disks are also commonly referred to as "floppy disks." Flexible disks have a thickness of approximately 0.003 inches and a diameter of approximately eight inches. During actual use in a disk drive, the disks are placed in a jacket to protect the disk and provide structural support. Prior to placing said flexible disks into the plastic jacket which completely surrounds the media, the disks are extremely vulnerable to damage. Though damage can be very slight and invisible to the naked eye, it can cause serious magnetic defects in the media. Damage to the media can be in the form of physical distortion rendering the center hole oblong or creasing the edges and/or contamination.

The tendency toward damage has effectively prevented the shipment of flexible disks except when said flexible disks are placed within the plastic jacket. Though placing the flexible media within the plastic jacket protects the media, it is not an acceptable solution on a practical basis. If the media is placed within the jacket merely for the purposes of shipment, the individual placement of a flexible disk within the cartridge is an expensive process. It consumes considerable time, requires large numbers of jackets and large packages to ship large quantities. Also, the media can be damaged during the procedure in which it is inserted into the jacket and removed therefrom.

Attempts have been made to ship unburnished flexible magnetic media, but said attempts have met with limited success. In the prior art a stack of flexible disks has been loaded upon a mandrel where the mandrel has been adapted for the center hole geometry of the media. Suitable end washers hold the disks at each end of the stack. This assembly, with mandrel and end washers in place, has then been placed in a carton and used for the purposes of shipment. However, it has been found that accelerations experienced during the shipping process cause center hole damage to the flexible media due to the engagement of the mandrel. As the geometry of the center hole is extremely critical for accurate positioning of the media on a flexible disk drive, shipping flexible media upon a solid mandrel has been found to be an unacceptable procedure. In the final analysis, there has not been a practical solution to the problem of shipping flexible mangetic media which is economical, prevents relative translation and rotation between the media, and protects the media from handling damage and particulate contamination.

SUMMARY OF THE INVENTION

It is thus an object of the present invention to provide a suitable package for a plurality of flexible magnetic disks to permit shipment of said disks without damage thereto.

It is a further object of the present invention to provide a technique for achieving such a package which is economical and readily implemented in manufacturing.

A preferred embodiment of the present invention is a package adapted for enclosing and protecting a plurality of flexible magnetic disks for the purposes of storage and/or shipment and a method for achieving same. The disks are stacked in coaxial alignment. The package for said flexible magnetic media consists of one or more layers of heat shrinkable plastic material formed about the plurality of flexible magnetic disks which (1) prevents relative motion between the disks (i.e., rotation and translation), and (2) holds the media in a substantially noncompliant stack so that the edges of the disks reinforce each other and provide mechanical strength to the package. A pliable collar is positioned about the outer peripheral edge of the stack.

The package of media formed according to the present invention is protected from contamination, has reinforced edges, stabilizes the individual disks such that they are stationary relative to one another and allows large quantities of the media to be included in a single package.

These and other objects and advantages of the present invention will no doubt become apparent to those skilled in the art after having read the following detailed description of the preferred embodiment which is illustrated in the several figures of the drawings.

IN THE DRAWINGS

DESCRIPTION OF THE PREFERRED EMBODIMENT

Figure 1A:
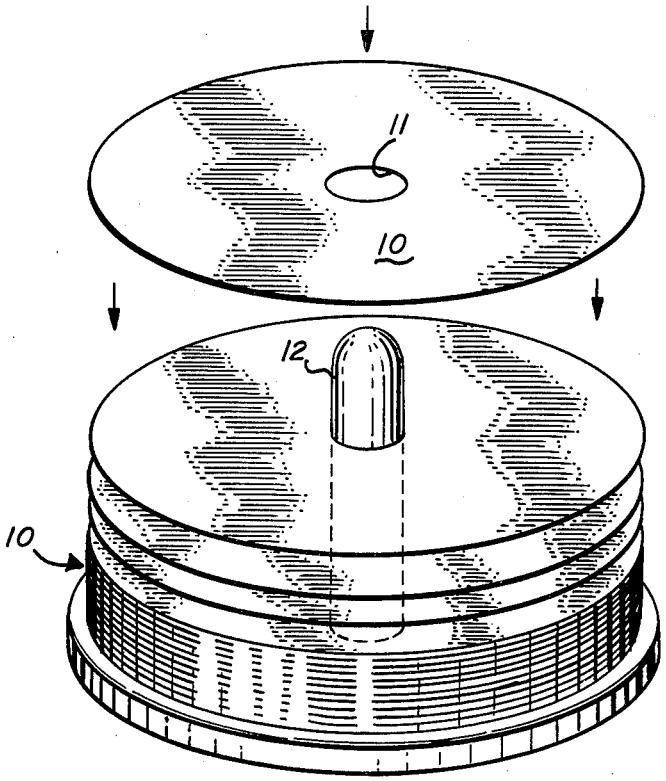
FIGS. 1A–1E illustrate the status of the package of flexible disks during various steps of forming the package according to the present invention.

Referring to FIGS. 1A–1E, there is illustrated in various steps the formation of a package according to the present invention. In step 1, as illustrated in FIG. 1A, a plurality of flexible magnetic disks 10 each with a central hole 11, are gently placed upon a mandrel 12 so that centers 11 of the individual disks are aligned coaxially. The outside diameter of mandrel 12 is slightly less than the inside diameter of hole 11 so that the disks slide over the mandrel.

Figure 1B:
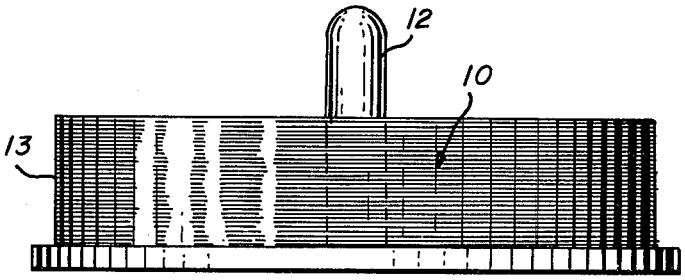

As illustrated in FIG. 1B, at step 2, after a plurality of flexible magnetic disks 10 have been positioned about the mandrel 12, the disks form a stack of flexible magnetic disks of substantial thickness. In the preferred embodiment, approximately 600 of said flexible magnetic disks 10 are stacked upon mandrel 12 so as to form a stack of a thickness of approximately two inches. When the flexible magnetic disks 10 are assembled upon mandrel 12, their edges 13 are substantially aligned so that the edge of each flexible magnetic disk 10 lends mechanical rigidity and support to the adjacent flexible magnetic disk 10. Thus, once the entire stack of flexible magnetic disks 10 is in place as shown in FIG. 1B, the stack has considerable resistance to edge damage in comparison to the resistance afforded by a single flexible magnetic disk 10.

Figure 1C:
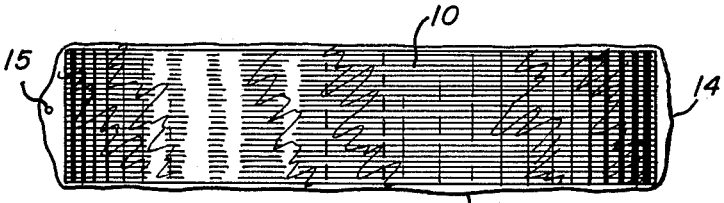

In step 3, as illustrated by FIG. 1C, the stack of disks are removed from mandrel 12 as a unit and placed within a suitably adapted plastic bag 14. The material of said plastic bag 14 is biaxial heat shrinkable material such as polypropylene. The thickness of polypropylene which has been successfully utilized is one and a half mils (i.e., 0.0015 inches). The plastic bag 14 is heat sealed after the flexible magnetic disks 10 are placed therewithin. In addition, a hole 15 is punched in the plastic bag 14 to provide an air escape when the plastic bag 14 is heat shrunk.

Figure 1D:
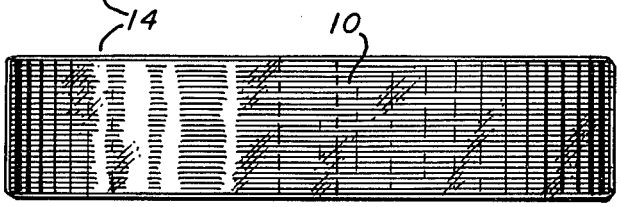

In step 4, as illustrated by FIG. 1D, the plastic bag 14 is "drawn down" around the plurality of flexible magnetic disks 10. Using the one and a half mil thick polypropylene bag 14, it has been found suitable to heat shrink said material by rapidly exposing the structure in step 3 to 325° F. temperature from one to two seconds. Steps 3 and 4 of FIG. 1 are preferably performed twice. That is, after plastic bag 14 is drawn down around the plurality of flexible magnetic disks 10 of step 4, the structure of step 4 is placed within another plastic bag 16. Then step 3 and 4 are repeated including punching a hole (not shown) in the bag 16. The plastic bag 16 is of the same size and material as the bag 14. The purpose of using a plurality of plastic bags 14 and 16 and heat shrinking them around the plurality of flexible magnetic disks 10 is to add additional protection and mechanical rigidity to the stack of disks. Moreover, as holes are required as a vent for escaping air each time a plastic bag is heat shrunk, using a plurality of plastic bags and repeating the processes of steps 3 and 4 creates a torturous path for any particulate contamination attempting to enter and obtain access to the interior compartment containing flexible magnetic disks 10 so long as the holes are not aligned on top of one another. For example, though a contaminant may possibly enter the bag 16 through the hole therein, that same particle would then have to find its way through the hole 15 of bag 14 before it would have access to the disks 10. The possibility of this occurring is extremely remote in view of the torturous path from the opening (not shown) is bag 16 to the opening 15 in the bag 14. Thus, the plurality of plastic bags, e.g., bags 14 and 16, enhances the mechanical effectiveness of the package as well as the ultimate protection achieved against particulate contamination. It is, of course, within the concept of the invention that a single plastic bag 14 or more than two bags could be used to practice the invention.

Figure 1E:
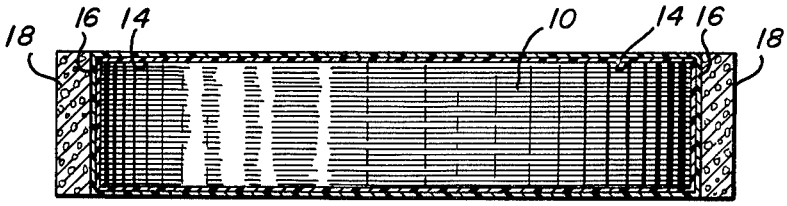

In step 5, as illustrated by FIG. 1E, once the stack of flexible magnetic disks 10 has been captured by the heat shrunk plastic bags 14 and 16, the composite structure is further protected against edge damage by placing a foam collar 18 around the peripheral edge. The width of the foam collar 18 is selected so as to extend for at least the height of the stack of flexible magnetic disks 10. After inclusion of foam collar 18, a structure is achieved which captures the plurality of flexible magnetic disks 10 and substantially prevents relative motion therebetween, edge damage, and exposure to particulate contamination.

Figure 2A:
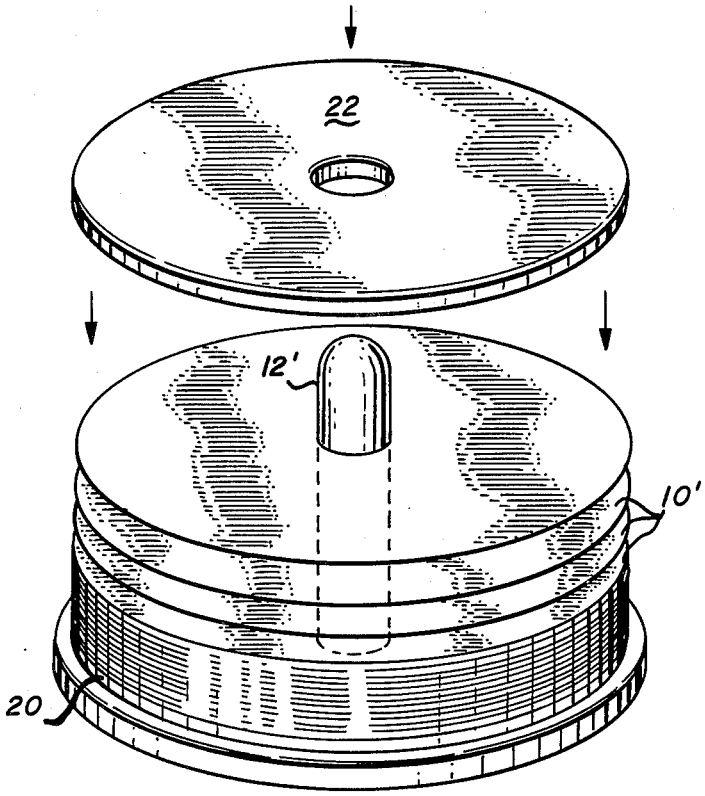
FIGS. 2A–2E illustrate an alternative package and method of forming the package according to the present invention.

FIGS. 2A–2E illustrate an alternate embodiment of a series of steps for establishing a package of the present invention. In order to simplify the description, those elements similar to the ones in FIGS. 1A–1E carry the same reference numerals and are distinguished by a prime designation. In FIGS. 2A–2E, a pair of plates 20 and 22 are placed about each axial end of the stack of flexible magnetic disks 10'. In step 1, as illustrated by FIG. 2A, the stack of disks 10' are placed upon mandrel 12' between the two plates 20 and 22.

Figure 2B:
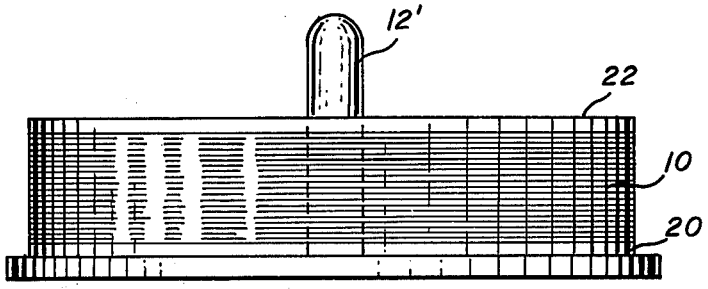
Figure 2C:
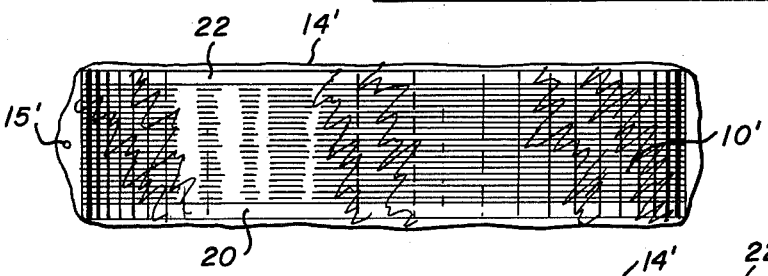

In step 2, as illustrated in FIG. 2B, the stack of disks 10', with plates 20 and 22 on each side, rest upon mandrel 12'. Then, in step 3 as illustrated in FIG. 2C, the stack of disks 10' along with plates 20 and 22 are placed within a plastic bag 14' for the purpose of heat shrinking said plastic bag around said flexible magnetic disks 10' and said plates 20 and 22. As in FIG. 1 described hereinabove, a hole 15' is placed in one corner of plastic bag 14' to allow for a tight "drawn down".

Figure 2D:
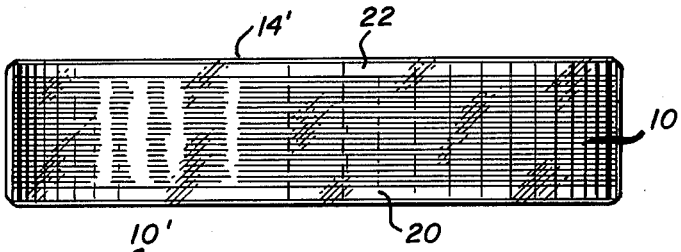
Figure 2E:
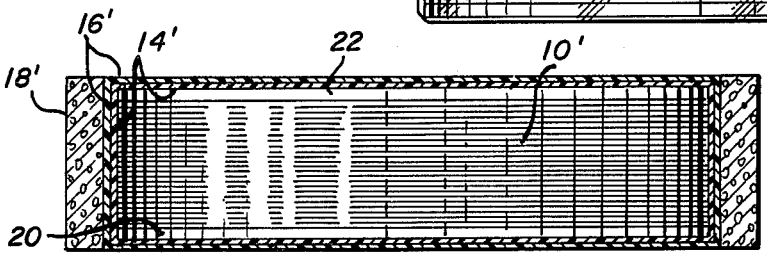

In step 4, as illustrated by FIG. 2D, the stack of disks 10' and plates 20 and 22 are all substantially captured in place by plastic bag 14' after the heat shrinking operation. The heat shrinking operation as applied to the embodiment in FIG. 2C is as described above for FIG. 1C. As described for steps 3 and 4 of FIGS. 1C and 1D, these steps may be repeated for steps 3 and 4 as illustrated by FIGS. 2C and 2D. Thus, bags 14' and 16' may be utilized to enhance the sealing and protection afforded to flexible magnetic disks 10'. In step 5, as illustrated in FIG. 2E, the foam collar 18' is placed about the structure to enhance edge protection of the stack.

Figure 3A:
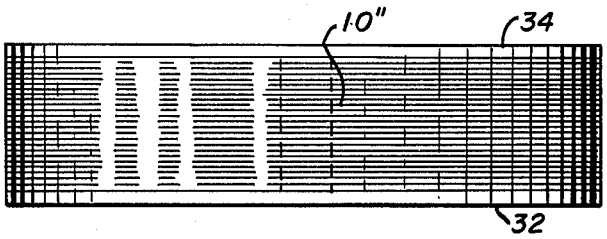
FIGS. 3A–3D illustrate a further alternative package and method for forming the package according to the present invention.
Figure 3B:
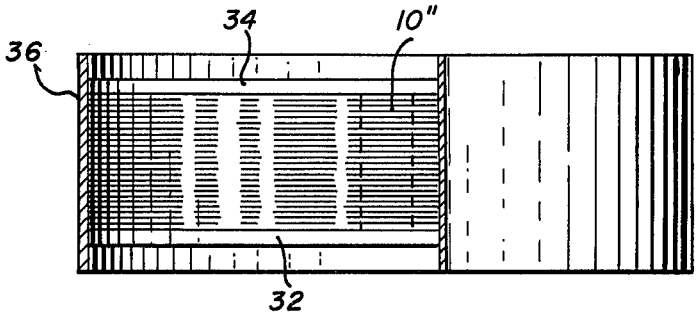
Figure 3C:
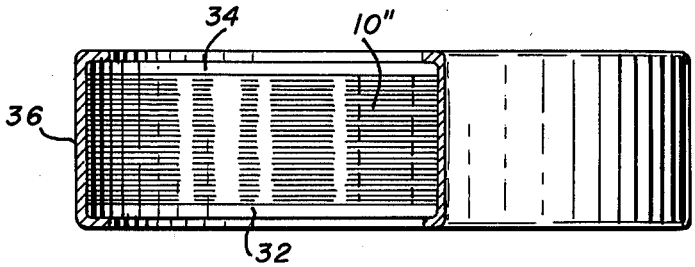
Figure 3D:
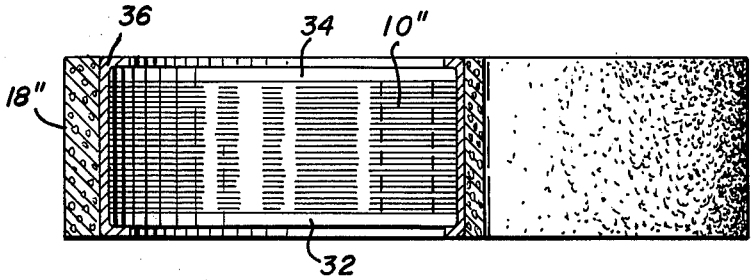

A further alternative embodiment to practice the present invention is illustrated in FIGS. 3A–3D which illustrate successive steps 1–4 to form a composite package. In order to simplify the description, those elements similar to FIGS. 1A–1E carry the same reference numeral and are distinguished by a double prime designation. In step 1, as illustrated in FIG. 3A a stack of uniformly aligned flexible magnetic disks 10'' are supported by plates 32 and 34. Plates 32 and 34 have an outside diameter substantially equal to flexible magnetic disks 10'' without a center hole. However, instead of utilizing a plastic bag composed of heat shrinkable material as used in the processes described in FIGS. 1A–1E and FIGS. 2A–2E, a ring of heat shrinkable material 36 is employed. The ring 36, as shown in step 2 of FIG. 3B, slides over the stack of flexible magnetic disks 10'' and plates 32 and 34. The ring 34 is thereafter exposed to heat. By suitably exposing ring 34 to heat, the ring 34 shrinks as shown in step 3 of FIG. 3C around the stack so as to exert axial as well as radial forces upon the stack of flexible magnetic disks 10'' and plates 32 and 34. After said heat shrinking operations, the entire structure is rendered relatively stiff and the flexible disks 10'' cannot rotate or translate with respect to one another. Step 4 of FIG. 3D shows a foam collar 18'' slid over the heat shrunk ring 36 for added edge protection. While plates 32 and 34 provide enhanced rigidity to the stack of flexible magnetic disks 10'', the method of FIGS. 3A–3D does not provide a structure sealed from dirt and particulate contamination as well as the embodiments of FIGS. 1A–1E and FIGS. 2A–2E.

The embodiments described herein deal with the problem of shipment or interplant transfer of "unburnished" flexible magnetic disks. The burnishing operation is a surface finishing procedure to which the magnetic media is later subjected so as to improve its magnetic performance. As media which has been burnished has been subjected to additional processing steps, its unit value is much increased over that of "unburnished" media. Moreover, as the burnishing operation is a mechanical surface treatment, subsequent operations to the burnishing process must treat the surface of the magnetic media with extreme care. Thus, the shipment of burnished media has heretofore met with limited success absent special and costly handling techniques since damage to the media has prohibited such an activity.

Figure 4:
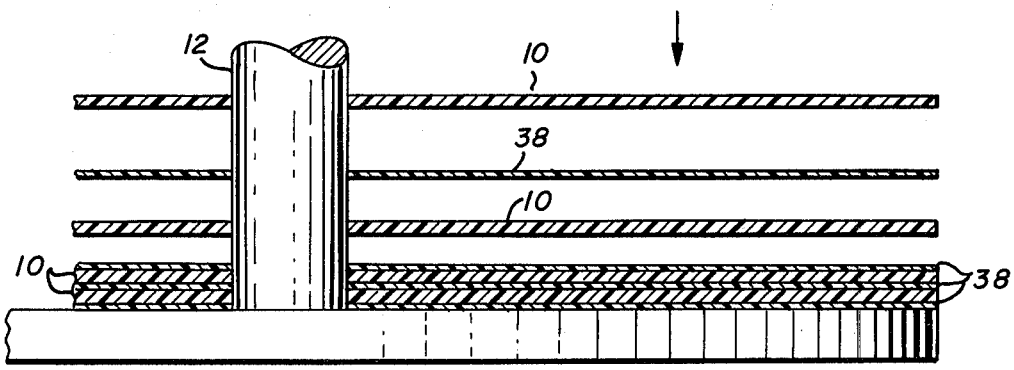
FIG. 4 illustrates a further alternative embodiment of the present invention employing separatos between the flexible disks.

The present invention is clearly applicable to ship burnished as well as unburnished media. In the embodiments described herein, the individual disks of media are permitted to contact abutting media when the stack of disks 10 are assembled upon mandrel 12. However, with reference to FIG. 4, when working with burnished media, individual sheets or separators 38 constructed of lintless and particulate-free paper, cloth, or plastic material are inserted between adjacent magnetic disks 10 so as to protect the surfaces of the disks 10 from each other. While it is more costly to insert such sheets of material between flexible magnetic disks 10, prevention of damage to the media is the ultimate concern.

While for the sake of clarity and in order to disclose the invention so that the same may be readily understood, specific embodiments have been described and illustrated, it is to be understood that the present invention is not limited to the specific means disclosed. It may be embodied in other ways that will suggest themselves to persons skilled in the art. For example, the descriptions included herein deal with specific application of the concept of the invention to flexible magnetic media. It is clear, though, that the invention may be practiced so as to protect any flexible material whose thickness dimension is small with respect to its length and width dimensions. It is particularly adapted to protect flexible materials when a stack of said flexible materials are identical in geometry and a plurality of same need to be assembled into one package. It has the advantage of sealing the plurality of said flexible materials and holding them in such a manner that the edges of one unit of flexible material give strength and add to the rigidity of its adjacent units so that the entire structure exhibits much enhanced strength and resistance to deformation. It is believed that this invention is new and that all such changes that come within the scope of the following claims are to be considered as part of this invention.

I claim:

1. An improved package adapted for a plurality of thin flexible materials of substantially identical geometry, the package comprising:

a first and a second substantially rigid plate of length and width dimensions substantially identical to that of a plurality of thin flexible materials to be packaged; and a heat shrinkable material having a hole therein to provide an air escape path suitably heat sealed and heat contracted so as to snugly contain said thin flexible materials therewithin with said thin flexible materials being aligned uniformly on top of one another in a stack with said first substantially rigid plate aligned on top of said stack and with said second substantially rigid plate aligned on the bottom of said stack so that the total thickness of said stack is less than the longest dimension of said thin flexible materials.

2. The improved package of claim 1 further comprising:

a plurality of layers of said heat shrinkable material, each layer having a separate hole located therein.

3. The improved package of claim 2 wherein, said hole in each layer of said heat shrinkable material is not aligned with respect to each other hole whereby environmental contamination is prevented from entering the improved package by a direct access path.

4. The improved package of claim 3 wherein, said thin flexible materials are flexible magnetic disks of less than five mils thickness.

5. The improved package of claim 3 further comprising:

a collar formed of a resilient material adapted to firmly fit over the periphery of the heat shrinkable material and snugly contain the heat shrinkable material therewithin to provide impact edge protection for said plurality of thin flexible materials.

6. The improved package of claim 3 further comprising:

a means for separating said thin flexible materials from contact with each other interposed between each individual item of thin flexible material and between the heat shrinkable material and said thin flexible materials of geometry substantially similar to the said thin flexible materials.

7. The improved package of claim 6 wherein said means for separating is a material substantially free of lint and particulate contamination.

8. The improved package of claim 6 wherein said thin flexible material is a flexible magnetic disk of less than five mils thickness.

9. An improved package for a plurality of thin flexible materials of substantially identical geometry aligned uniformly on top of one another with their thickness dimension much less than their respective length and width dimensions, comprising:

first and second substantially rigid plates having length and width dimensions substantially similar to the respective length and width dimensions of said thin flexible materials located on the top and bottom of said uniformly aligned thin flexible materials so that the thickness of the plurality of said thin flexible materials plus said first and second plates is less than the longest dimension of said thin flexible materials;

the heat shrinkable material formed substantially into the shape of the peripheral edge of said uniformly aligned thin flexible materials with said first and second substantially rigid plates located on the top and bottom thereof with said edge sealing means adapted to snugly fit over said thin flexible materials with said first and second substantially rigid plates located on the top and bottom thereof so as to hold said thin flexible materials and said first and second substantially rigid plates preventing relative motion between said thin flexible materials and between said thin flexible materials and said first and second substantially rigid plates.

10. The improved package of claim 9, further comprising:

a collar formed of a resilient material adapted to firmly fit over the periphery of the heat shrinkable material to provide impact edge protection for said plurality of thin flexible material.

11. The improved package of claims 9 or 10, further comprising:

a means for separating said thin flexible materials from contact with each other within said separating means has geometry substantially similar to said thin flexible materials and separates each item of thin flexible material from each other item of thin flexible materials.

12. The improved package of claim 11 wherein said means for separating said thin flexible materials is a material substantially free of lint and particulate contamination.

13. The improved package of claim 12 wherein said thin flexible materials are flexible magnetic disks of less than five mils thickness.

14. A method for manufacturing an improved package for a plurality of thin flexible materials of substantially identical geometry with their thickness dimensions much less than their respective length and width dimensions, comprising the steps of:

(a) assembly of said plurality of thin flexible materials into a stack with each item of thin flexible material uniformly aligned on top of its adjacent item of thin flexible material;

(b) placement thereafter of said uniformly aligned stack of thin flexible materials into a means for wrapping formed into the shape of a bag adapted to receive said uniformly aligned stack of thin flexible materials wherein said means for wrapping is constructed of a heat shrinkable material with a small hole located along one peripheral edge;

(c) thereafter heat shrinking of said means for wrapping to form a first heat shrunk wrapping about said stack; and (d) placement of a collar around said heat shrunk wrapping wherein said collar is constructed of a resilient material adapted to snugly fit over the periphery of said heat shrunk wrapping so as to lightly compress said heat shrunk means for wrapping.

15. The method of claim 14, further comprising immediately after step (c) and before (d) the step of:

placement of said first heat shrunk wrapping and stack into a second means for wrapping and thereupon suitably heat contracting said second means for wrapping to form a second heat shrunk wrapping about said stack and said first heat shrunk wrapping.

16. The method of claim 14 or 15 wherein, step (a), further includes a first and a second substantially rigid plate located on the top and bottom, respectively, of said uniformly aligned thin flexible materials.

17. The method of claim 14 or 15 wherein, step (a), further includes means for separating said thin flexible materials from contact with each other are interposed between each item of thin flexible materials, said means for separating being constructed of a material substantially free of lint and particulate contamination.

18. A method for manufacturing an improved package for a plurality of thin flexible materials of substantially identical geometry with their thickness dimension much less than their respective length and width dimensions, comprising the steps of:

(a) assembly of said plurality of thin flexible materials into a stack with each item of thin flexible material uniformly aligned on top of its adjacent item of thin flexible material;

(b) placement thereafter of said uniformly aligned stack of thin flexible materials between a first and a second substantially rigid plate with length and width dimensions substantially similar to said thin flexible materials so that said first plate and said second plate sandwich said stack of thin flexible materials therebetween;

(c) placement thereafter of the uniformly aligned stack of thin flexible materials between said first and second plates into an edge sealing means formed into the shape of the peripheral edge of the assembly out of a heat shrinkable material;

(d) heat shrinking of said edge sealing means;

(e) placement of a collar around said heat shrunk edge sealing means formed from a resilient material so as to lightly compress the peripheral edge.

19. The method of claim 18, further comprising:

means in step (a), for separating said thin flexible materials from contact with each other by interposing said separating means between each item of said thin flexible material wherein said separating means if constructed of a material substantially free of lint and particulate contamination.

* * * * *